United States Patent [19]

McKinney

[11] 4,227,650

[45] * Oct. 14, 1980

[54] FLUID DISPENSER AND NOZZLE STRUCTURE

[75] Inventor: James C. McKinney, Atlanta, Ga.

[73] Assignee: Ethyl Products Company, Richmond, Va.

[ * ] Notice: The portion of the term of this patent subsequent to Jul. 17, 1996, has been disclaimed.

[21] Appl. No.: 961,512

[22] Filed: Nov. 17, 1978

Related U.S. Application Data

[63] Continuation of Ser. No. 774,146, Mar. 3, 1977, abandoned, and a continuation-in-part of Ser. No. 729,798, Oct. 5, 1976, Pat. No. 4,161,288.

[51] Int. Cl.[2] ..... B65D 47/34

[52] U.S. Cl. ..... 239/333; 222/380; 222/472; 222/494; 239/464; 239/492; 239/526; 239/570; 239/579

[58] Field of Search ..... 239/331, 333, 337, 354, 239/452, 456, 464, 491–497, 526, 539, 570, 574, 577, 579, 583, 586, 329; 222/341, 380, 383, 384, 467, 472, 481, 482, 494, 497, 207, 385

[56] References Cited

U.S. PATENT DOCUMENTS

| | | | |
|---|---|---|---|
| 2,805,891 | 9/1957 | Sanborn | 222/494 X |
| 3,187,960 | 6/1965 | Gorman | 222/380 X |
| 3,685,739 | 8/1972 | Vanier | 239/333 |
| 3,749,290 | 7/1973 | Micallef | 222/207 X |
| 3,840,157 | 10/1974 | Hellekamp | 222/385 X |
| 4,013,229 | 3/1977 | Rohs | 239/493 |

*Primary Examiner*—Andres Kashnikow

*Attorney, Agent, or Firm*—Donald L. Johnson; John F. Sieberth; E. Donald Mays

[57] ABSTRACT

A fluid pump dispenser includes a nozzle structure having a flexible member which functions as an outlet check valve and O-ring seal, and which cooperates with a threaded nozzle cap to vary the discharge pattern of the dispenser responsive to twisting adjustment of the cap. Fluid is discharged through the nozzle structure by actuating a trigger to reduce the volume of a pump chamber in communication with the outlet check valve. The volume of the pump chamber may be reduced by operating a piston within the chamber or by flexing a wall of a tubular member having an open end in communication with the outlet valve.

3 Claims, 9 Drawing Figures

FLUID DISPENSER AND NOZZLE STRUCTURE

RELATED APPLICATIONS

This application is a continuation of application Ser. No. 774,146, filed Mar. 3, 1977, which application is now abandoned, and is a continuation-in-part of application Ser. No. 729,798, filed Oct. 5, 1976 now U.S. Pat. No. 4,161,288, July 17, 1979.

BACKGROUND OF THE INVENTION Aerosol dispensers widely used in the packaging industry present two major problems; atmospheric pollution from the propellant and disposal of the cannister without the risk of explosion and the accompanying hazard to personal safety. The use of hand actuated pump dispensers as a substitute for aerosol dispensers obviates these problems but is not practical in many circumstances because conventional pump dispensers are difficult to ship and expensive to construct. Accordingly, it is a primary object of the present invention to provide a novel fluid dispenser which is inexpensively fabricated and easily shipped.

Fluid pump dispensers are generally provided with a nozzle structure including a check valve for blocking communication between the pump chamber and a nozzle aperture. A nozzle structure of this type is illustrated, e.g. in the Vanier U.S. Pat. No. 3,685,739, dated Aug. 22, 1972. It is desirable that the nozzle structure be adjustable to provide widely varying discharge patterns and for disabling the outlet check valve. A seal must also be provided to prevent fluid leakage at the sliding interface of the nozzle structure adjustment means. It is, of course, also desirable that the number of separately molded parts of the fluid dispenser be minimized. Accordingly, it is an object of the present invention to provide a novel fluid dispenser having an adjustable nozzle for varying the discharge pattern of the dispenser, comprising only two separately molded parts, attached to the dispenser housing.

Typically, fluid is discharged from a spray dispenser by reducing the volume of a pump chamber, thereby opening a pressure responsive outlet check valve. In conventional spray dispensers the volume of the pump chamber may be varied by operating a piston, as illustrated in the Hellenkamp U.S. Pat. No. 3,840,157, or the volume of the pump chamber may be varied by flexing a wall of a flexible tubular member, having an outlet valve integral therewith, as illustrated in the Micallef U.S. Pat. No. 3,749,290. Both dispensers are configured in the approximate shape of a pistol, the nozzle being located at the end of a forwardly protruding portion of the housing and the pump chamber being located within the portion of the housing grasped by the hand. While the Micallef dispenser has several inherent advantages, the dispenser has a disadvantage in that the protruding nozzle cap is provided separate and displaced from the outlet valve of the dispenser, which is formed by interengaging surfaces of the flexible tubular member, thus restricting the accessibility of the outlet valve for adjustment to modify the discharge pattern of the dispenser.

Accordingly, it is a further object of the present invention to provide a spray dispenser having a pump chamber defined by a flexible tubular member, and a nozzle structure displaced from the pump chamber, having an outlet check valve which cooperates with an adjustable nozzle cap to vary the discharge pattern of the dispenser.

These and many other objects and features of the present invention will be apparent from the claims and from the following description when read in conjunction with the appended drawings.

THE DRAWINGS

DETAILED DESCRIPTION OF PREFERRED EMBODIMENTS

A preferred embodiment of the fluid dispenser of the present invention includes a nozzle structure having an aperture through which the fluid is discharged and an outlet check valve for blocking communication between the aperture and the pump chamber responsive to pressure in the pump. The check valve comprises a valve seat and an elastic valve member. The nozzle structure includes a nozzle cap for making adjustable pressural contact with the elastic valve member to vary the discharge pattern of the dispenser. Fluid flow between the cap and elastic member is deflected by bosses of varying heights on the cap or the elastic member. The fluid dispenser also includes a variable volume pump chamber and nozzle structure. In one alternate embodiment the volume of the pump chamber is varied by movement of a piston operated by a pivoting trigger. In another embodiment the pump chamber includes a flexible tubular member, and the volume of the chamber is varied by flexing the tubular member by pivoting a trigger.

To facilitate an understanding of the methods and structures of the present invention, reference may be had to the following:

TABLE OF CONTENTS

A. Fluid Dispenser with Piston
B. Fluid Dispenser with Pump Chamber Defined by Flexible Tubular Member
C. Structure of Flexible Outlet Valve Member
D. Operation of the Nozzle Structure

A. Fluid Dispenser Structure

Figure 1:
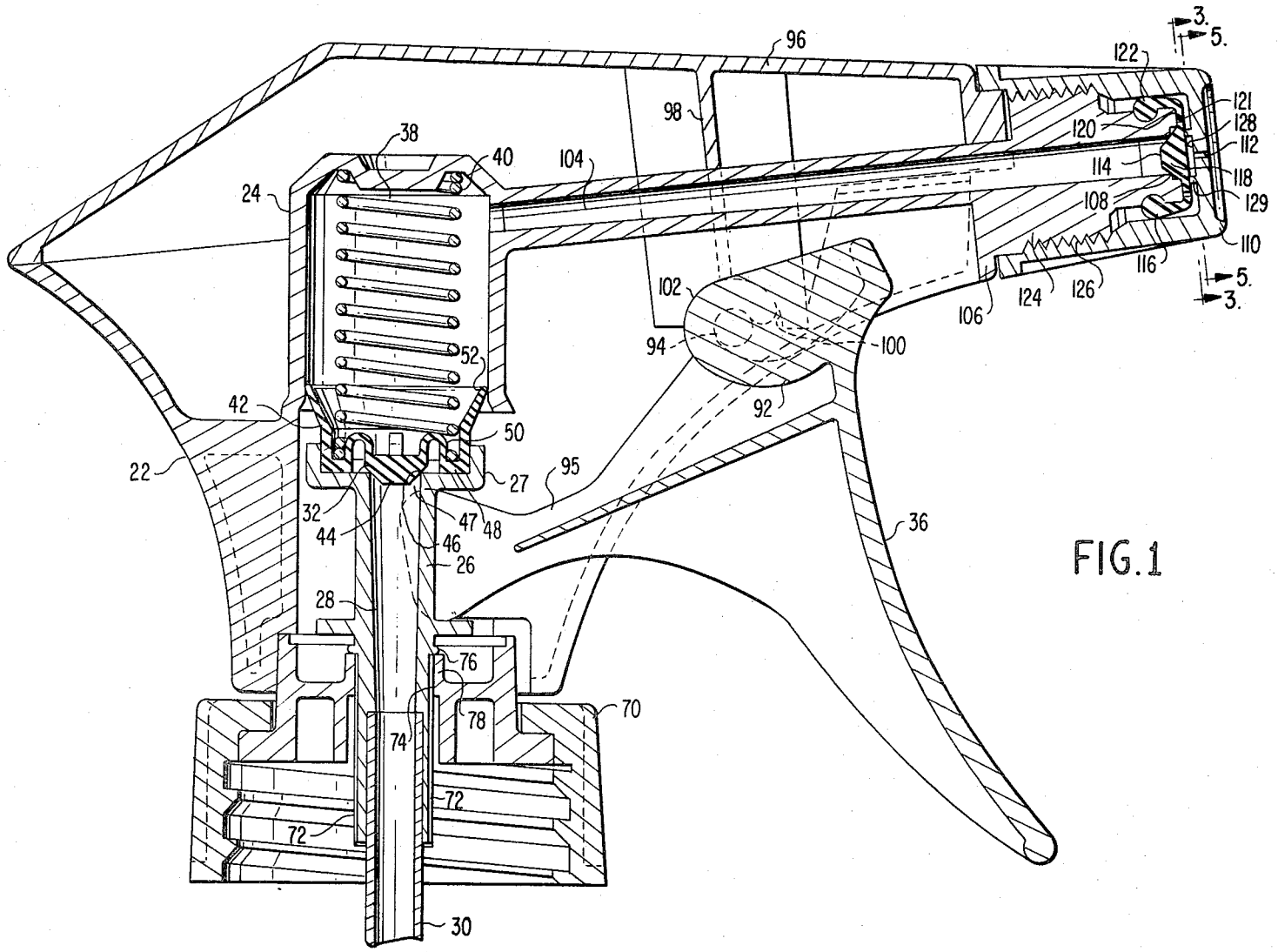
FIG. 1 is a sectional view in elevation taken through the major axis of a piston dispenser with a nozzle structure of the present invention.

With reference to FIG. 1, a fluid dispenser includes a housing 22 adapted for mounting on the threaded orifice of a fluid container (not shown). A pump chamber 24 is disposed within the housing 22. A fluid supply and discharge assistant 26 includes a piston 27 and a conduit 28 which provides fluid to the pump chamber 24 from the container. The piston conduit 28 may be provided with an inlet conduit 30 adapted to extend into the container to draw fluid into the pump chamber 24 via the piston conduit 28 and an inlet check valve 32. The piston 27 may be actuated against the bias of a coil spring 40 by squeezing trigger 36 thereby reducing the enclosed volume 38 of the pump chamber 24.

A flexible member 42 in contact with the piston 27 functions as the movable portion of the inlet check valve 32 and as a piston ring. Alternatively, the flexible member may be formed integral with the piston 27. The flexible member 42 may include a central portion 44 adapted to contact a valve seat 46 integral with the piston to block a piston conduit orifice 47 and thereby block communication between the container and the pump chamber in response to the pressure within the pump chamber. The central portion 44 of the flexible member 42 may be frustoconical in shape to facilitate sealing engagement with the valve seat 46. In an alternate embodiment, the piston conduct may be blocked in response to pressure within the pump chamber by a ball check valve (not shown).

The flexible member may further comprise an annular portion 48 contacting the piston and the coil spring 40. A plurality of radially oriented, arch-shaped bands 50 of a thinner cross section than the central portion may be used to connect the central portion to the annular portion and permit relative movement therebetween. A radial edge 52 of the flexible member 42 may form a fluid tight seal between the piston 27 and the inner wall of the pump chamber 24.

With continued reference to FIG. 1, the trigger 36 of the dispenser has a spiral-shaped member 92 which pivots on an inwardly projecting peg 94 on opposite sides of the dispenser housing. It may be noted that single or plural spiral-shaped members may be formed in either the housing or the trigger and single or plural pegs may be formed in the other of the housing and trigger.

The housing of the dispenser may include a separate housing head portion 96. The housing head portion 96 may be formed with a downwardly depending ear 98 for engaging the spiral-shaped member 92. A curved surface 100 of the ear 98 may slidably engage a portion 102 of the spiral-shaped member to prevent the spiral-shaped member from disengaging the pegs 94.

An arm 95 of the trigger is adapted to mate with the piston and piston conduit thereby limiting the arc through which the trigger may pivot to the length of the piston stroke. Fluid in the pump chamber 38 may be discharged from the dispenser through an outlet conduit 104 and a nozzle structure 106. The nozzle structure 106 may include a valve seat 108 communicating with the outlet conduit 104 and a nozzle cap 110 having an aperture 112 through which the fluid is discharged. An outlet check valve 114 includes flexible member 116 and the valve seat 108. A movable central portion 118 of the flexible member 116 may contact the valve seat 108 to block communication between the aperture 112 and the pump chamber 38 responsive to pressure within the pump chamber 38.

The central portion 118 of the flexible member may be frustoconical in shape with the central portion 118 surrounded by an annular portion 120 having apertures 121 to provide a fluid flow path when the central portion is not seated on the valve seat. An integral O-ring 122 is provided by the peripheral portion of the flexible member 114 to form a seal between the nozzle cap 110 and the housing 124 surrounding the outlet conduit.

The housing 124 and the nozzle cap 110 may be provided with threads 126. Rotation of the nozzle cap 110 with respect to the housing 124 may be operative to adjust the pressural contact between the inner central surface 128 of the nozzle cap and the central portion of the flexible member 118. Either the central portion of the flexible member 114 or the inner central portion of the nozzle cap 128 may be formed with bosses 129 for contacting the other of the cap or flexible member. The bosses may be operative to deflect the flow of fluid adjacent to the bosses. Adjustment of the nozzle cap may vary the contact between the central portion of the flexible member and the bosses when the outlet check valve is open, thereby varying the discharge pattern of the dispenser.

B. Fluid Dispenser with Pump Chamber Defined by Flexible Tubular Member

Figure 2:
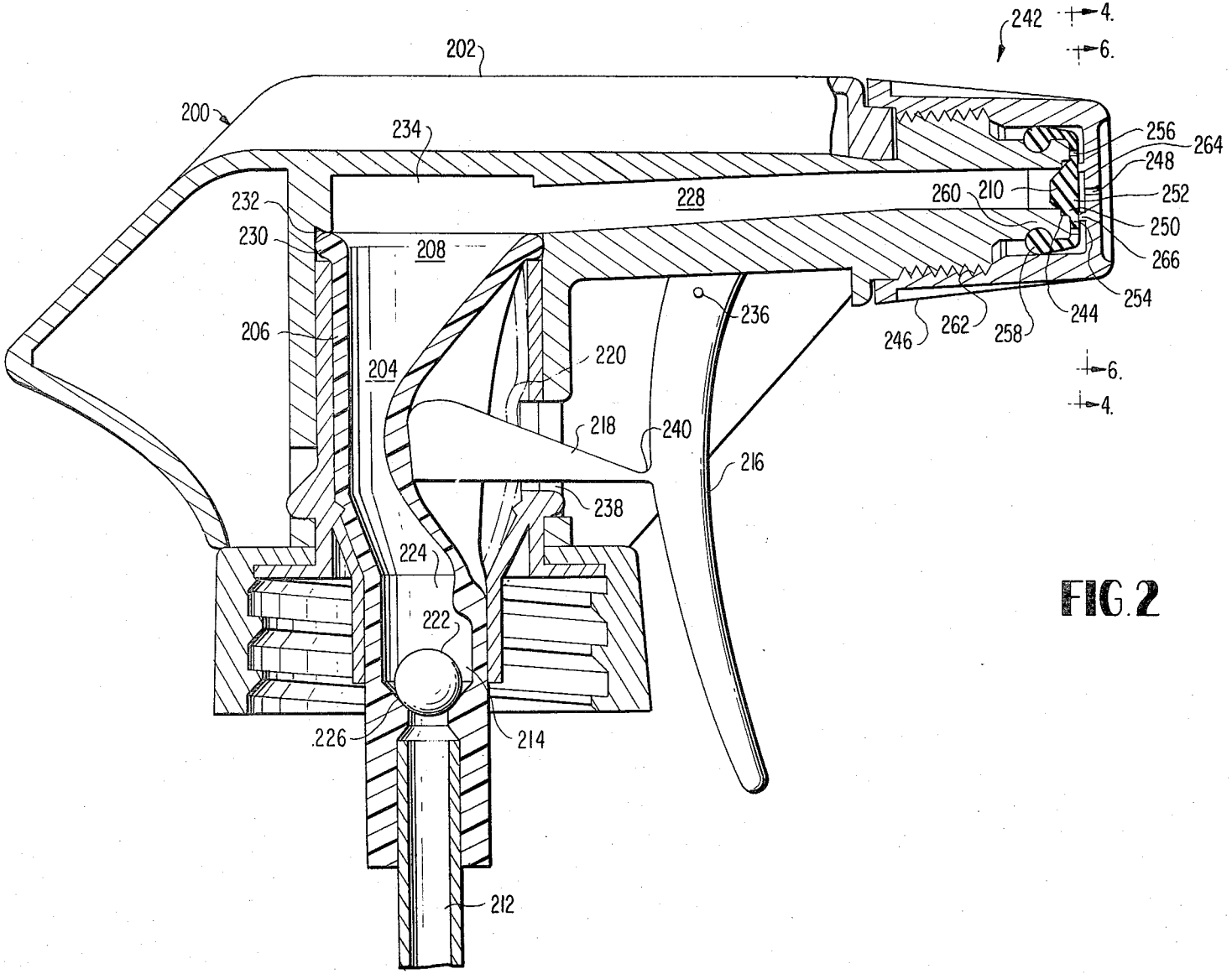
FIG. 2 is a sectional view in elevation taken through a major axis of a dispenser with a flexible tubular member and nozzle structure of the present invention.

With reference to FIG. 2, a fluid dispenser 200 includes a housing 202 adapted for mounting on the threaded orifice of a fluid container (not shown). A variable volume pump chamber 204 is located within the housing 202. The pump chamber may be partially defined by a flexible tubular member 206 having an open axial end 208 in communication with an outlet check valve 210. Fluid may be supplied to the variable volume pump 204 via an inlet conduit 212 and an inlet check valve 214. The dispenser may be actuated by pivoting a trigger 216 to press an arm 218 of the trigger against a portion of the wall of the flexible tubular member 206, thereby reducing the enclosed volume of the pump chamber 204. When the trigger is released the elastic bias of the tubular member may tend to return the member 206 to its distended position 220 (shown in phantom).

The inlet check valve may include a ball 222 located in a recess 224 in a lower portion of the tubular member. When the trigger is squeezed the volume of the pump chamber 204 is reduced and the pressure therein increased, thereby seating the ball 202 on an annular seating flange 226 of the tubular member and closing the valve. When the trigger is released, the flexible tubular member may return to its fully distended position, the ball 222 is no longer biased by pressure within the variable volume chamber and is free to unseat from the annular flange portion 226 of the tubular member.

The upper axial end 208 of the flexible tubular member 206 may communicate with the outlet check valve 210 via outlet conduit 228. A cylindrical chamber 234 in the housing 202 may cooperate with the flexible member to define the pump chamber and conduct fluid discharged from the hollow of the flexible tubular member to the outlet conduit 228. The flexible tubular member may be sealably positioned with respect to the cylindrical chamber by means of a flange 230 formed in an upper portion of the wall of the tubular member which engages a corresponding indentation 232 in the housing 202.

The trigger 216 may be mounted to the housing 202 for pivoting about axis 236, perpendicular to the plane of the Figure. The arm 218 of the trigger 216 may be pivotably mounted to the trigger and pass substantially horizontally through an aperture 238 in the housing. The arm 218 may be molded integrally with the trigger 216 and have a narrowed portion 240 joining the arm thereto, to permit pivoting of the arm with respect to the trigger.

Fluid in the pump chamber 204 may be discharged from the dispenser through the outlet conduit 228 and a nozzle structure 242. The nozzle structure 242 may include a valve seat 244 communicating with the outlet conduit 228, and a nozzle cap 246 having an aperture 248 through which the fluid is discharged. The outlet check valve 210 may include flexible member 250 and the valve seat 244. A movable central portion 252 of the flexible member 250 may contact the valve seat 244 to block communication between the aperture 248 and the pump chamber 204 responsive to pressure within the pump chamber.

The central portion 252 of the flexible member may be frustoconical in shape with the central portion 252 surrounded by an annular portion 254 having apertures 256 to provide a fluid flow path when the central portion is not seated on the valve seat. An integral O-ring may be formed in the peripheral portion of the flexible member 250 to form a seal between the nozzle cap 246 and a portion 260 of the housing surrounding the outlet conduit.

The housing portion 260 and the nozzle cap 246 may be provided with threads 262. Rotation of the nozzle cap 246 with respect to the housing portion 260 may be operative to adjust the pressural contact between the inner central surface 264 of the nozzle cap and the central portion 252 of the flexible member 250. Either the central portion 252 of the flexible member or the inner central portion of the nozzle cap may be formed with bosses 266 for contacting the other of the cap of flexible member. The bosses may be operative to deflect the flow of fluid adjacent to bosses. Adjustment of the nozzle cap may vary the contact between the central portion of the flexible member and the bosses when the outlet check valve is open, thereby varying the discharge pattern of the dispenser. The nozzle cap 246 may be tightened down to reduce or eliminate the clearance for movement of the central portion 252 of the flexible member, thereby seating the central portion on the valve seat 244 and disabling the dispenser. The construction and operation of the nozzle structure is described in greater detail below.

In operation, the spray dispenser of FIG. 2 may be disposed on a fluid container and the trigger 216 squeezed and released to prime the dispenser. The release of the trigger permits the flexible tubular member to return to its distended position, thereby reducing the pressure in the pump chamber, closing the outlet check valve 210, and drawing fluid into the pump chamber 204 via the inlet conduit 212 and the inlet check valve 214. If the trigger is again squeezed, the volume of the pump chamber 204 is reduced, thereby pressuring the pump chamber, closing the inlet check valve 214 and opening the outlet check valve 210. Fluid in the pump chamber may be discharged through the aperture 248 via chamber 234, outlet conduit 228, outlet check valve 210 and apertures 266.

C. Structure of Flexible Outlet Valve Member

Figure 3:
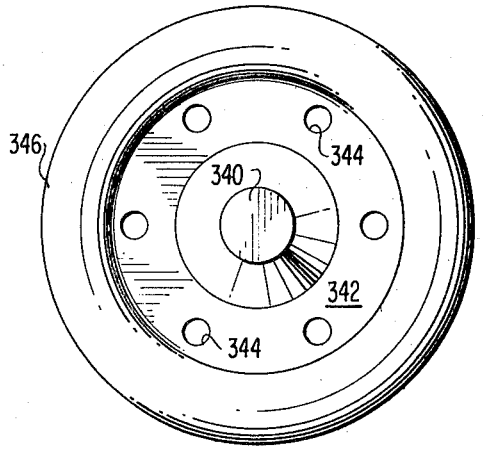
FIG. 3 is a section taken along either lines 3—3 of FIG. 1 or lines 4—4 of FIG. 2.
Figure 4:
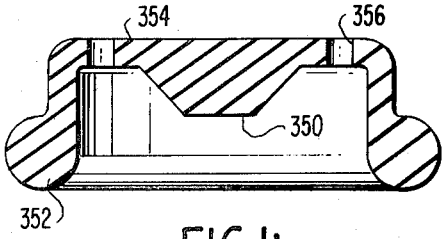
FIG. 4 is a section taken along lines 10—10 of FIG. 3.
Figure 5:
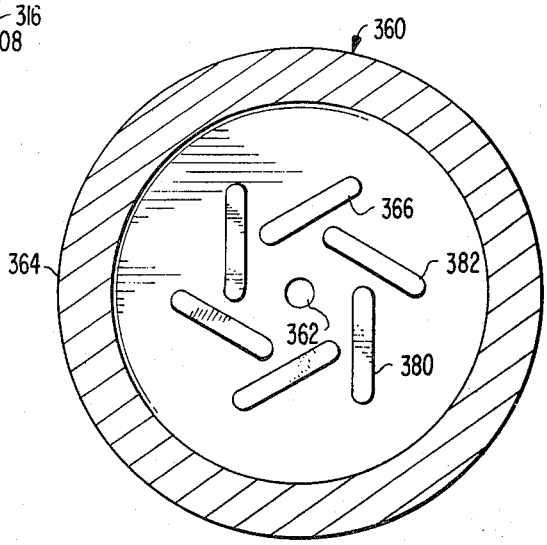
FIG. 5 is a section taken along either lines 5—5 of FIG. 1 or lines 6—6 of FIG. 2.

With reference to FIGS. 3–5, description is made of the structure of the flexible outlet valve member (valve member 116 of the embodiment of FIG. 1; valve member 150 of the embodiment of FIG. 2).

FIG. 3 is a cross sectional view taken along lines 3—3 of FIG. 1 or line 4—4 of FIG. 2. As shown in FIG. 3, the flexible member has a central, frustoconical portion 340 surrounded by an apertured annular portion 342. The apertures 344 provide fluid flow passages between the outlet conduit and the aperture in the nozzle cap when the check valve is open. The O-ring portion (not shown) of the flexible member is attached to the peripheral edge 346 of the apertured annular portion 342 of the flexible member.

As shown more clearly in FIG. 4, the frustoconical portion 350 of the flexible member is connected to the integral O-ring 352 by the apertured annular portion 354 which may be thinner in cross section than the central portion 150 to permit relative movement of the central portion 150 with respect to the O-ring 152. Apertures 356 in the annular portion 354 may provide fluid flow passages through the member.

Figure 6:
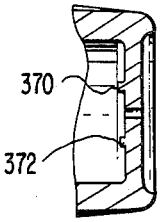
FIG. 6 is a section taken along lines 12—12 of FIG. 5.

FIG. 5 is a cross sectional view taken along line 5—5 of FIG. 1 or line 6—6 of FIG. 2. As shown in FIG. 5, the nozzle cap 360 includes an aperture 362 formed in the central circular wall 364 of the nozzle cap. Bosses 366 may be formed on the central inner surface of the nozzle cap and, as shown in FIG. 6, the bosses 370 and 372 may be of different heights. In one embodiment of the invention, adjacent bosses may be of alternate heights, e.g., bosses 380 of FIG. 5 may be of one height while bosses 382 are of a different height.

D. Nozzle Structure Operation

Figure 7:
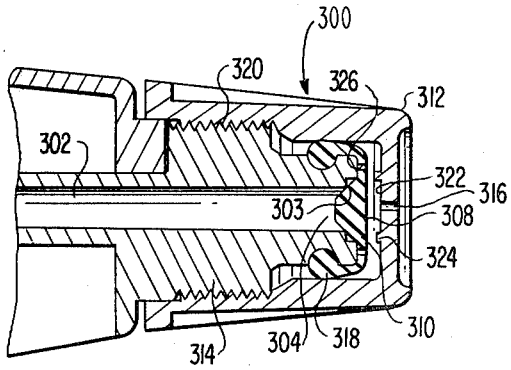
FIGS. 7-9 are sections of the nozzle structure of the embodiments of the present invention illustrated in either FIG. 1 or FIG. 2 showing the adjustment of the structure to vary the nozzle discharge pattern.
Figure 8:
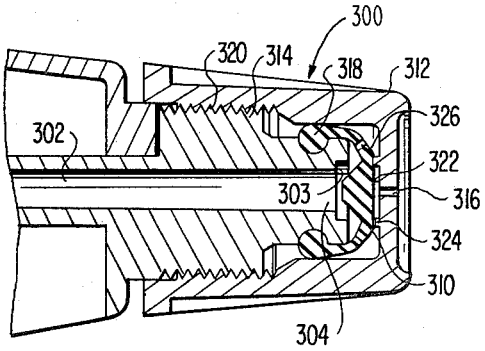
Figure 9:
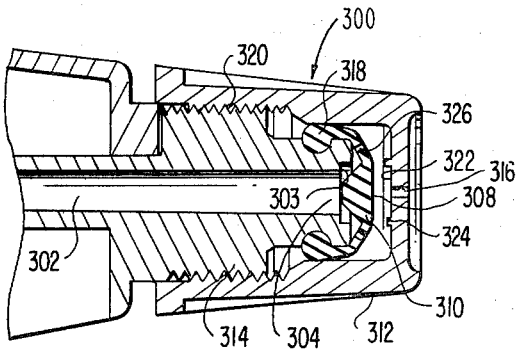

The operation of the spray dispenser nozzle structure may be understood with reference to FIGS. 7 through 9. As shown in FIG. 7, fluid may be supplied to the nozzle structure 300 via a conduit 302. An orifice 304 of the conduit 302 forms a valve seat 303 for an outlet check valve 306, and a frustoconical shaped central portion 308 of the flexible member 310 may be utilized to block the orifice 304 in response to pressure within the conduit 302. If the pressure in the conduit 302 is less than the ambient pressure about the nozzle structure, the central portion 308 of the flexible member may be seated on the valve seat 303 as shown in FIG. 7. When the pressure in the conduit exceeds the ambient pressure the central portion 308 of the flexible member may be unseated from the valve seat 303 as shown in FIG. 8 and FIG. 9 where like features of FIG. 7 are identified with like numbers.

With reference to FIGS. 7, 8 and 9, a nozzle cap 312 may be provided for threaded engagement with the portion 314 of the dispenser defining conduit 302 and may be formed with an aperture 316 through which fluid is discharged from the dispenser. The nozzle cap engages an O-ring portion 318 of the flexible member to retain the periphery of the flexible member in a fixed position with respect to the valve seat 303 and to provide a fluid tight seal between the nozzle cap and the conduit defining portion 314 of the dispenser. Rotation of the nozzle cap 312 along the path defined by the threads 320 may vary the distance and/or pressural contact between the central portion of the flexible member and the inner central surface 322 of the nozzle cap. Bosses 324 may be formed in either the inner central surface 322 of the nozzle cap or the central portion 308 of the flexible member to deflect fluid flow. Alternatively, fluid directing recesses may be formed in either the inner central surface 322 of the nozzle cap or the central portion 308 of the flexible member to direct fluid flow.

As shown in FIG. 8 and FIG. 9, fluid pressure in the conduit 302 may unseat the central portion 308 of the flexible member from the valve seat 303 and fluid may be discharged from the aperture 316 via the orifice 304 and the apertures 326 in the flexible member. When the cap is positioned with respect to the flexible member as shown in FIG. 8, the discharged fluid must pass between bosses 324 before it is discharged through aperture 316 and, therefore, is swirled. The resultant discharge pattern may be a spray dispensed over a relatively wide area. When the nozzle cap is positioned with respect to the flexible member as shown in FIG. 9, the fluid may pass from apertures 326 in the flexible member through aperture 316 in the nozzle cap without passing between the bosses 324, and is not swirled by the bosses. the resultant discharge pattern may, therefore, be in the form of a stream.

Where bosses of varying heights are provided the discharge pattern of the sprayer may be varied by selectively adjusting the nozzle cap to selectively cause contact between the flexible member and some or all of the bosses when the outlet check valve opens.

The principles, preferred embodiments and modes of operation of the present invention have been described in the foregoing specification. The invention which is intended to be protected is not, however, to be construed as limited to the particular forms disclosed, since these are to be regarded as illustrative rather than restrictive. Variations and changes therefore may be made by those skilled in the art without departing from the spirit and scope of the present invention.

I claim:

1. An apparatus for dispensing fluids from a container comprising:

(a) a housing;

(b) a pivotable trigger mounted on said housing;

(c) a pump chamber in said housing in communication with the container, the volume of which chamber is varied responsive to the pivoting of said trigger;

(d) an outlet valve on said housing in communication with said pump chamber, said valve being of a unitary construction of a non-metallic, elastic material including a peripheral O-ring portion; a thin, flexible, apertured, annular portion; and a thick, solid, central portion for normally blocking communication with said chamber and responsive to the pressure in said chamber to stretch the thin, annular portion to thereby open the solid, central portion to communicate said chamber with said apertured, annular portion; and (e) a nozzle cap on said housing making sealing engagement with said O-ring portion and adapted for adjustably contacting the central portion of said outlet valve member to vary the discharge pattern of the fluid dispensed.

2. The apparatus of claim 1 wherein said pump chamber has interior walls which receive a flexible, elastic, tubular member terminating in an open upper end that is retained in a groove provided in said interior wall of said pump chamber, an open, downwardly facing, cylindrical chamber provided in said housing directly above and in open communication with said open, upper end of said tubular member; a conduit in said housing having its inner end in direct open communication with said cylindrical chamber and its outer end normally closed by said central portion of said outlet valve; and said elastic tubular member having a flexible wall adapted to be flexed responsive to the pivoting of said trigger to vary the volume of said pump chamber and to open and close said outlet valve.

3. An apparatus for dispensing fluids from a container comprising:

(a) a housing;

(b) a pivotable trigger mounted on said housing;

(c) a pump chamber in said housing in communication with the container, the volume of which chamber is varied responsive to the pivoting of said trigger;

(d) an outlet valve on said housing in communication with said pump chamber, said valve being of a unitary construction of a non-metallic, elastic material including a peripheral O-ring portion; a thin, flexible, apertured, annular portion; and a thick, solid, central portion for normally blocking communication with said chamber and responsive to the pressure in said chamber to stretch the thin, annular portion to thereby open the solid, central portion to communicate said chamber with said apertured, annular portion;

(e) a nozzle cap on said housing making sealing engagement with said O-ring portion and adapted for adjustably contacting the central portion of said elastic valve member to vary the discharge pattern of the fluid dispensed; and (f) one of said nozzle cap and said elastic outlet valve member being formed with bosses of different heights for imparting a swirl to fluid dispensed from said nozzle, whereby movement of said nozzle cap away from said outlet valve member varies the discharge pattern of the apparatus.

* * * * *